US005246194A

United States Patent [19]

Garcia

[11] Patent Number: 5,246,194

[45] Date of Patent: Sep. 21, 1993

[54] SAFETY MECHANISM FOR SECURING PANELS TO SUPPORTING POSTS

[76] Inventor: José A. R. Garcia, c/o Pez Volador, No. 26, 28007 Madrid, Spain

[21] Appl. No.: 706,238

[22] Filed: May 28, 1991

[51] Int. Cl.[5] ..... E04B 2/00

[52] U.S. Cl. ..... 248/228; 248/225.1; 248/222.1; 52/588; 52/764

[58] Field of Search ..... 248/228, 222.1, 225.1; 52/588, 581, 584, 775, 764

[56] References Cited

U.S. PATENT DOCUMENTS

| | | | |
|---|---|---|---|
| 1,840,942 | 1/1932 | Fahrenwald | 52/588 X |
| 3,469,873 | 9/1969 | Glaros | 52/588 X |
| 4,951,992 | 8/1990 | Hockney | 52/588 X |

FOREIGN PATENT DOCUMENTS

| | | | |
|---|---|---|---|
| 1175857 | 7/1961 | Fed. Rep. of Germany | 52/775 |
| 2203356 | 8/1973 | Fed. Rep. of Germany | 52/775 |
| 2459335 | 2/1981 | France | 52/588 |
| 834138 | of 0000 | United Kingdom | 52/588 |

*Primary Examiner*—Alvin C. Chin-Shue
*Attorney, Agent, or Firm*—Helfgott & Karas

[57] ABSTRACT

A mechanism for securing panels to supporting vertical posts wherein each panel is a profile having at least one lateral inwardly protruding U-shaped channel and an upper and lower channel formed at an upper and lower side of the panel, respectively, includes reinforcing billets which are inserted in guides formed by the lower channels and the upper channels of the two panels, coupled to each other as the two panels to be connected to the supporting post overly each other. Angular members are provided for fixing the panels to the supporting posts. Each angular member has a T-shaped bend portion inserted in the lateral U-shaped channel of the panel in assembly.

9 Claims, 4 Drawing Sheets

SAFETY MECHANISM FOR SECURING PANELS TO SUPPORTING POSTS

BACKGROUND OF THE INVENTION

A safety mechanism for making up and securing panels onto supporting elements for signalling boards and other uses has been disclosed in Spanish patent No. 8900902, in which the signalling boards are assembled in an overlying manner on vertical posts. Each panel has a profile which allows it to be fixed both to the posts and to its immediate panel by using two different types of setting up. The setting up of the lower panel has been accomplished by different means that allow fixing of the lower panel onto the contiguous higher one, and also the lower panel onto the higher one.

The Spanish Certificate of Addition No. 8902015 discloses the use of a lower panel formed by a different profile, based upon two rear protrusions which could be trapped onto the post by fixing means, which are identical to the fixing means used for the upper panels also with regard to the post.

The use of two different fixing means, as well as the two different profiles, makes the set considerably more expensive regarding costs of material and labor.

SUMMARY OF THE INVENTION

It is an object of the present invention to provide a board constituted by overlying and repeating one and only profile which is provided with fixing means including a part having a T-shaped tailpiece, flat irons, and corresponding bolts and nuts.

A further object of the present invention is an alternative use of simple fixing means to provide for the case when they are placed in high and difficult to reach positions, such as, for instance, the fixing of the highest panel at the upper side thereof.

Another object of this present invention is to provide a safety mechanism which includes reinforcing and catching billets between panels, provided at their ends with a spear point-shaped construction, in order to make their withdrawal easier using a reinforcing and catching billet with the same characteristics. These billets also act as trapping elements between the panels.

DETAILED DESCRIPTION OF THE INVENTION

Figure 1:
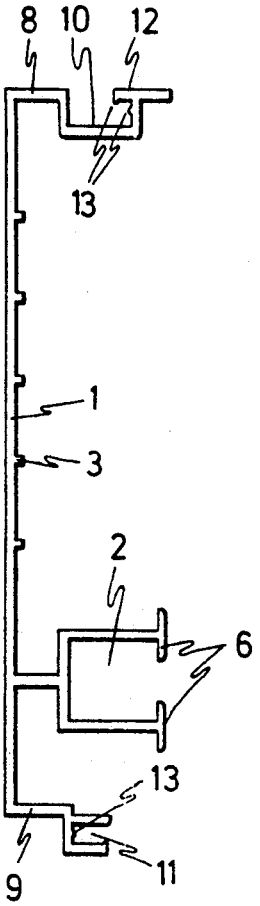
FIG. 1 shows a side view of the profile of the panel.

The mechanism of the present invention makes use of a panel (1) having its front area completely plain and prepared to be labelled and having on its opposite side which is an upper part, one or several U-shaped channels (2).

Namely, panel or profile (1) is provided in its rear side with a U-shaped channel (2), as well as some small spaced-apart protrusions (3) that enhance the strength of the profile.

Figure 2:
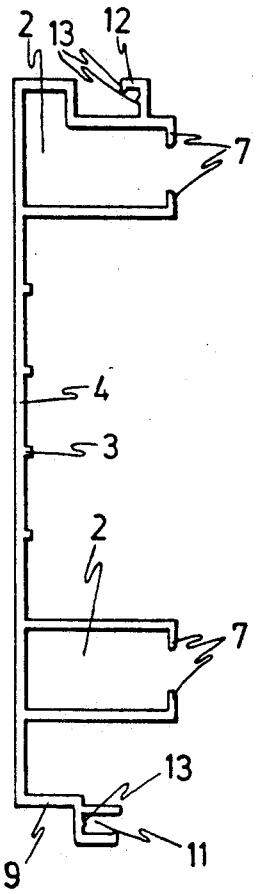
FIGS. 2 and 3 are side views showing other embodiments of the profile of the panel.
Figure 3:
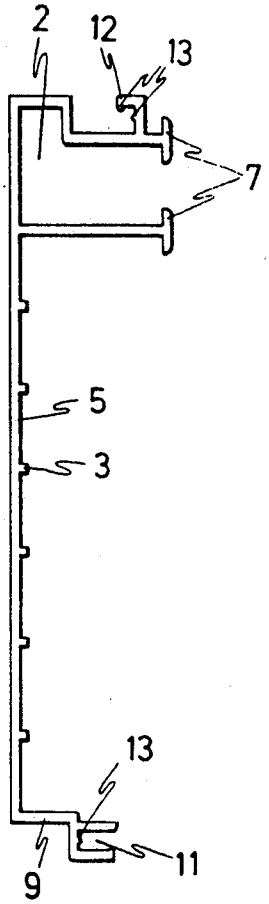

In another embodiment, the profile may be provided on its rear side with two U-shaped channels (2), as can be observed on profile (4) shows in FIG. 2. In the same way, in a third embodiment, profile or panel (5) has the channel (2) placed at its upper end area.

Channels (2) have T-shaped ends (6) or inwardly protruding projections (7) extending towards each other.

The profile (1) of FIG. 1 and its two variants, i.e., the profiles (4) and (5), have two rearwardly extending protrusions, an upper one (8) and a lower one (9), and are also provided with U-shaped channels (10) and (11). The upper channel (10) forms an upper opening and the lower channel (11) forms a rear side opening. The upper channel (10) has a run (12) at its mouth that reduces it.

Figure 10:
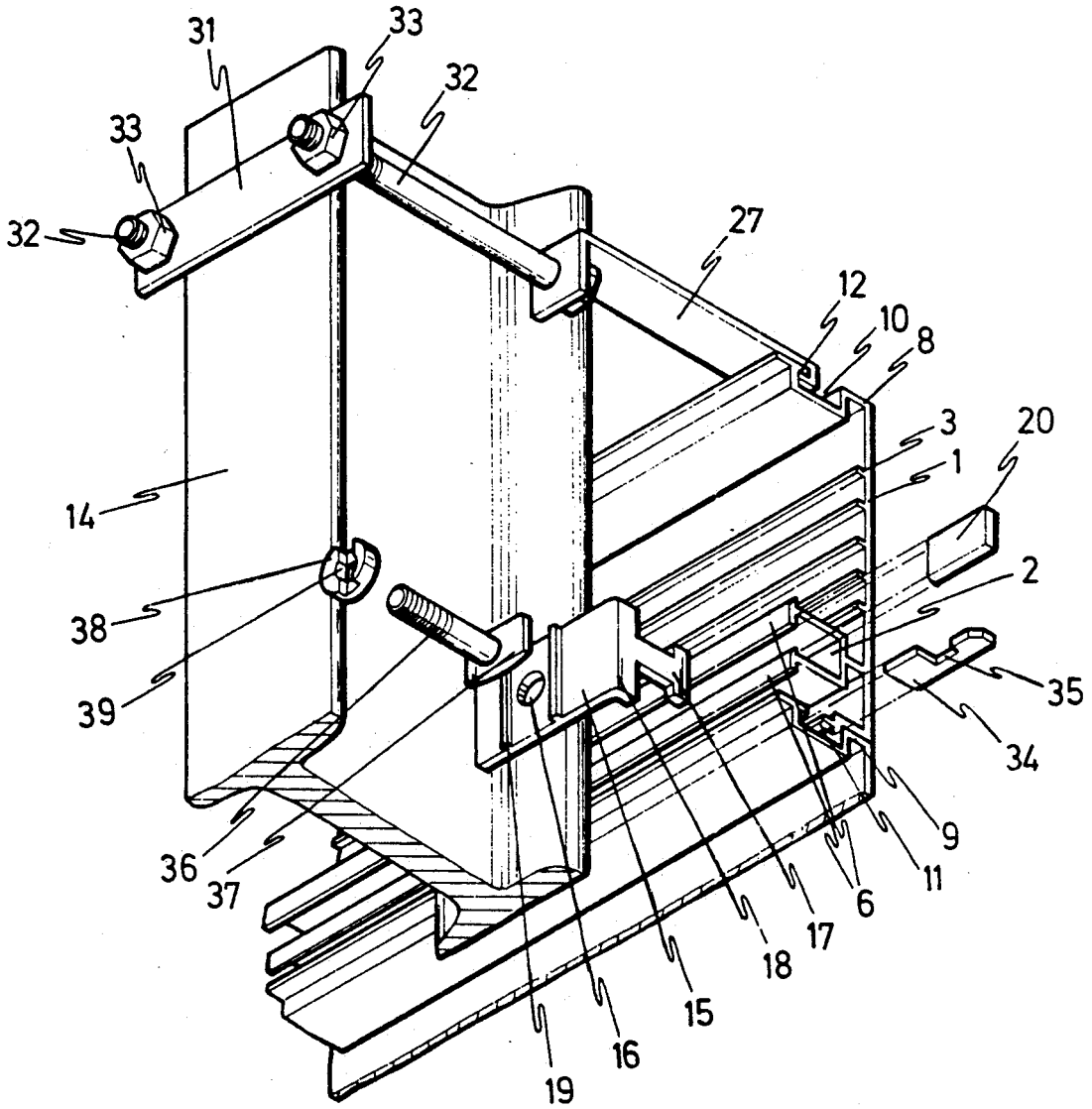
FIG. 10 is a perspective partially sectional view of the assembly of the panels on which both alternative fixing means have been provided.
Figure 11:
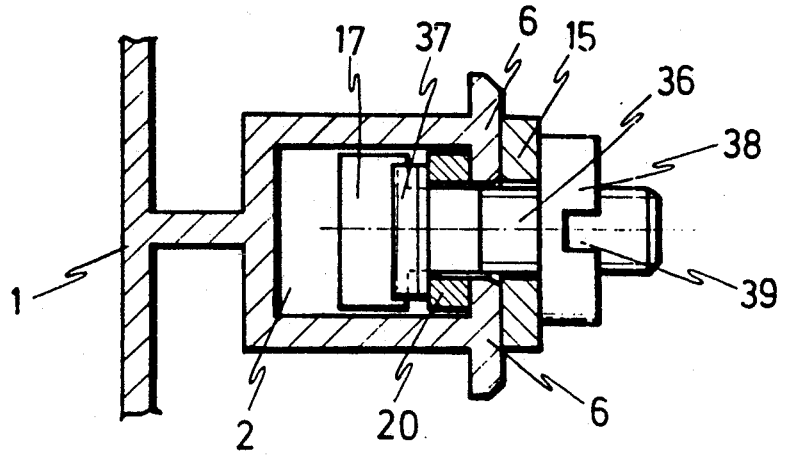
FIG. 11 is a vertical side sectional view of the fixing means of the panels onto the supporting posts.
Figure 12:
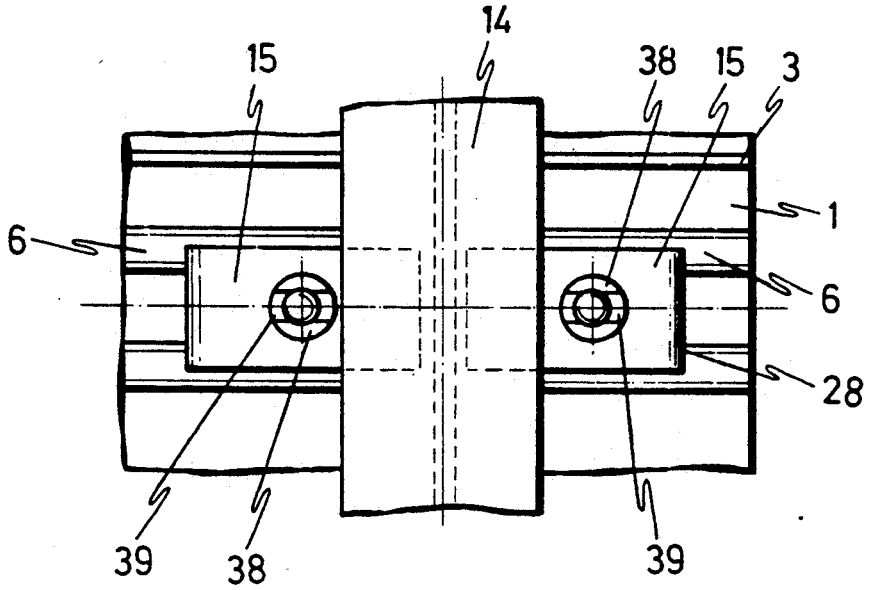
FIG. 12 is rear elevation view of the fixing means of FIG. 11.

U-shaped channels (10) and (11) have longitudinal ribs (13) in their inner sides of preferentially triangular cross-section. Fixing means are constituted by a series of elements and flat irons that can be adjusted to each other and to the profile (1) and to supporting posts (14) as shown in FIG. 10.

Figure 4:
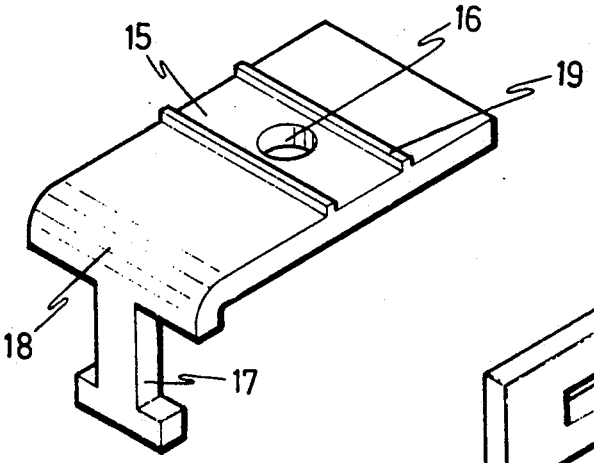
FIG. 4 is a perspective view of the part that can be used for fixing between the panels and supporting posts and which is provided with a tailpiece of a T-shape.
Figure 5:
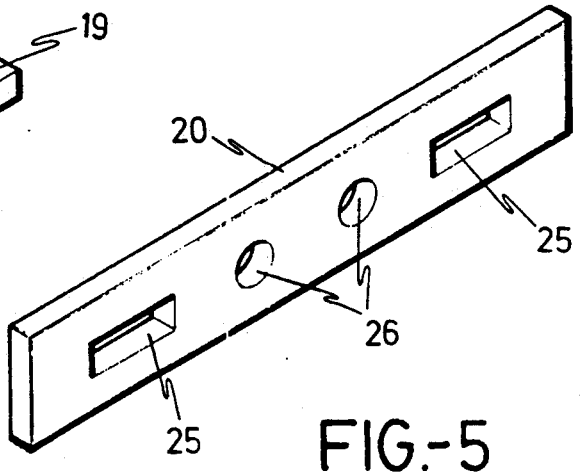
FIGS. 5, 6 and 7 each shows a perspective view of a flat iron of a different embodiment that can be used in the fixing system of the safety mechanism of the present invention.
Figure 6:
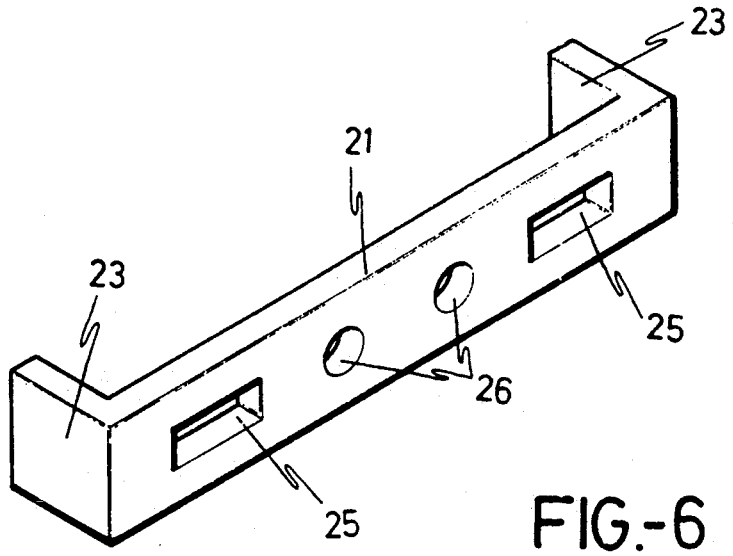
Figure 7:
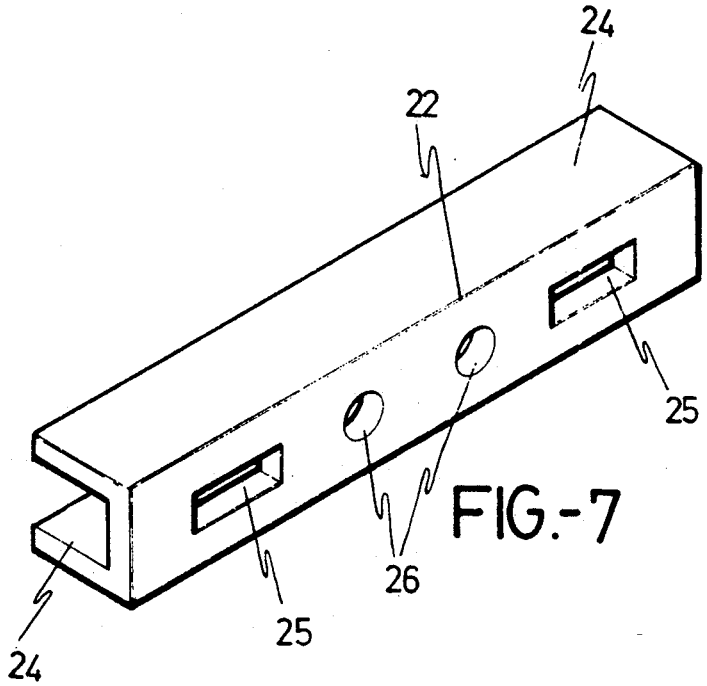

As shown in FIG. 4, an angular member (15) includes a substantially rectangular plate having a corresponding orifice (16), either rectangular or circular, and a T-shaped tailpiece (17) on its shorter side, that is provided with a curved portion (18).

Member (15) may optionally have on its upper surface two transversal ribs (19) which act as stop and safety elements against the handling of the fixing nuts.

The fixing means comprise irons of three different types, a flat iron (20) that has a rectangular configuration, an iron (21) that is provided at its ends with angular flaps (23), and an iron (22) that has two elongated opposing walls (24) which form an assembly of U-shaped configuration.

Irons (20), (21) and (22) have two rectangular drilled orifices (25) and two circular or rectangular drilled orifices (26) positioned between orifices (25).

Figure 8:
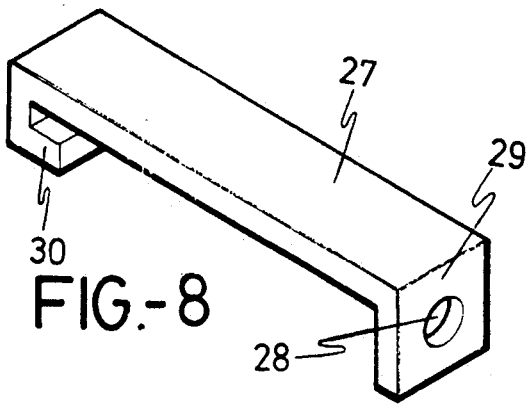
FIG. 8 is a perspective view of the part that can be used in the fixing system provided for the upper area of the highest panel of the assembly.
Figure 9:
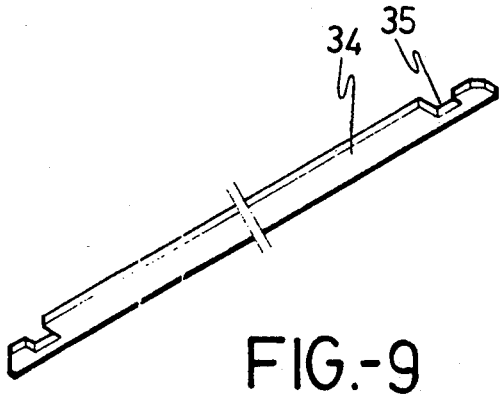
FIG. 9 is a perspective view of a reinforcing and catching billet between the panels.

Fixing means also comprise a connecting member (27) shown in FIG. 8 and consisting of a rectangular iron provided with a bend or flap (29) on one of its ends, having a central orifice (28), while on the other end it has a double bend (30) formed as a hook. This member (27) forms part of the alternative fixing means that are placed on high and difficult to reach areas. These alternative fixing means are complemented with flat irons (31) shown in FIG. 10, which are provided with orifices near their ends for receiving two threaded stems (32) and secured with corresponding fixing nuts (33).

In securing of two overlaid profiles (1), (4) or (5) to each other, when their respective upper (10) and lower (11) channels are fitted together, a guide is produced to receive reinforcing and catching billets (34) which have ends (35) of a spear point shape as shown in FIG. 10.

The assembly of panels (1), (4) or (5) on the posts or beams (14) is realized in the following way:

The fixing of the panel (1), (4) or (5), e.g., the lower one, is performed by inserting a suitable iron (20), (21) or (22) in channel (2) and by placing stems (36) having heads (37) into the internal orifices (26) of iron (20). Afterwards, the T-shaped tailpieces (17) of members (15) are inserted in channel (2) and into the rectangular orifices (25) of the respective iron (20), (21) or (22); the members (15) are turned by 90° until their orifices (16) fit on the stems (36) and then nuts (38) are tightened. Each nut has a diagonal safety cutout (39) so that their withdrawal will require a special tool. In this way, the fixing of panels (1), (4) or (5) on the inner wings of the supporting posts (14) is achieved.

In the case when angular member (15) and irons (20), (21) and (22) have orifices (16) and (26) of rectangular configuration, the assembly will be realized by coupling all the parts and finally introducing head (37) through such orifices (16) and (26) and turning the stem (36) by 90° to tighten nut (38).

Further, when the upper panel (1), (4) or (5) is placed so to be assembled, it is placed so that the lower channel houses in the upper channel (10) of the lower panel (1), (4) or (5), forming a guide to receive the billets (34), that act as a clamp to prevent separation of panels (1) and that can be easily withdrawn, as their ends (35) are spear point-shaped when hooked with one another. The longitudinal ribs (13) in channels (10) and (11) allow a perfect guidance of billets (34) along the channels (10) and (11) because the billets have a perfect fitting along those channels without producing material seizure.

Next, fixing is performed based on the steps described above for the first panel (1).

The alternative fixing method, which may be set, for instance, on the upper area of upper panels (1), (4) or (5) is performed by fitting the hook (30) of the connecting member (27) shown in FIG. 8 into the corresponding U-shaped channel (2) and then inserting the stems (32) into the orifice (28) of the flap (29), while at the same time, the ends of the stems (32) pass through the orifices of the flat iron (31) to fix the whole assembly with the aid of corresponding nuts (33) to the posts (14).

I claim:

1. A safety mechanism in combination with panels to be secured to supporting posts, comprising panels each being a profile having at least one lateral U-shaped channel extending inwardly of a side wall of the profile and defined by side portions which are terminated in end portions extending transversely of said side portions and having one of T-shape and L-shape; fixing means for coupling said panels to the supporting posts, said profile further including an upper U-shaped channel and a lower U-shaped channel formed at an upper side and a lower side of said profile, respectively, said upper channel being formed with an upper opening and a lateral protrusion partly closing said upper opening and said lower channel being formed with a lateral opening, said lower channel of one panel being coupled with said upper channel of another panel, when two panels to be assembled with said supporting posts overly each other, so as to form a guide; and reinforcing billets each received in a respective guide, wherein said fixing means comprise angular members connected to a supporting post and each partly received in said inwardly protruding lateral U-shaped channel, each angular member including a plate having a central opening of one of circular and rectangular shape and a T-shaped tailpiece connected thereto by a curved portion.

2. The mechanism as defined in claim 1, wherein said plate has two parallel ribs on an outer side thereof.

3. The mechanism as defined in claim 1, wherein said fixing means further comprise irons each provided for insertion in said inwardly extending lateral U-shaped channel, said irons each having rectangular openings at end portions thereof for fixing said T-shaped tailpiece of said angular member in said U-shaped lateral channel and orifices of one of circular and rectangular configuration; said fixing means further including threaded bolts each passing through said central opening of the plate of the respective angular member and one of said orifices to secure the respective angular member to the supporting post and the respective panel.

4. The mechanism as defined in claim 3, wherein said irons include a flat plate-shaped iron, a C-shaped iron and a U-shaped iron.

5. The mechanism as defined in claim 1, wherein said fixing means further include connecting members each having a longitudinal portion, a bent flap portion transversely protruding of said longitudinal portion and having a central orifice, and a double bend forming a hook for insertion in said upper U-shaped channel, and threaded bolts each connected to the supporting posts by nuts and extending through said central orifice to secure the respective panel to the supporting post.

6. The mechanism as defined in claim 1, wherein said reinforcing billet has a spear point-shaped end.

7. The mechanism as defined in claim 1, wherein said fixing means further include nuts for fixing said angular members to the supporting posts, said nuts each having a safety cutout to ensure handling of said nuts only with a special tool.

8. The mechanism as defined in claim 1, wherein said upper and lower U-shaped channel each has longitudinal ribs on inner sides thereof.

9. The mechanism as defined in claim 8, wherein said ribs are of semicircular configuration.

* * * * *